United States Patent [19]

Winter

[11] Patent Number: 4,744,206

[45] Date of Patent: May 17, 1988

[54] APPARATUS FOR APPLYING HEAT-SHRINKABLE PLASTIC SLEEVES TO CONTAINERS

[75] Inventor: Horst Winter, Neutraubling, Fed. Rep. of Germany

[73] Assignee: Krones AG Hermann Kronseder Maschinenfabrik, Neutraubling, Fed. Rep. of Germany

[21] Appl. No.: 97,125

[22] Filed: Sep. 16, 1987

[30] Foreign Application Priority Data

Sep. 21, 1985 [DE] Fed. Rep. of Germany ..... 3533758

[51] Int. Cl.[4] ..... B65B 11/00

[52] U.S. Cl. ..... 53/585; 53/293; 53/295; 53/296

[58] Field of Search ..... 53/291, 293, 295, 296, 53/297, 298, 582, 585

[56] References Cited

U.S. PATENT DOCUMENTS

| | | | |
|---|---|---|---|
| 3,802,152 | 4/1974 | Strub | 53/296 X |
| 3,974,628 | 8/1976 | Konstantin | 53/297 X |
| 4,148,171 | 4/1979 | Westlund | 53/296 X |
| 4,318,685 | 3/1982 | Konstantin | 53/585 X |
| 4,497,156 | 2/1985 | Scheidegger | 53/295 X |
| 4,514,966 | 5/1985 | Konstantin | 53/291 X |
| 4,649,697 | 3/1987 | Konstantin | 53/291 X |
| 4,693,059 | 9/1987 | O'Donnell | 53/585 X |

FOREIGN PATENT DOCUMENTS 2503689 4/1981 France .

*Primary Examiner*—Robert L. Spruill
*Assistant Examiner*—Steven P. Weihrouch
*Attorney, Agent, or Firm*—Fuller, Puerner & Hohenfeldt

[57] ABSTRACT

A flattened tubular plastic tube having one pair of edge creases is withdrawn from a vertical axis reel and passed through horizontal axis rollers to impart a pair of intermediate creases. Cooperating rotating and stationary blades cut the plastic tube into short sleeves which are immediately gripped between actuator shoes on a pair of translating chains and a pair of translating frictional belts. The compressively interfaced actuator shoes and belts advance the sleeves to the inlet of a channel defined by laterally spaced apart slide members which have v-grooves into which opposite creased edges are inserted at the inlet whereupon hooks on another chain loop push the sleeves through the channel. The channel width converges so the sleeves open as they are pushed along the channel to be engageable by the head of a passing bottle. In another embodiment laterally spaced apart parallel translating chain loops carrying interfacing but spaced apart gripper shoe elements having grooves to recline one pair of sleeve edge creases between them supplant the v-grooved slide members of the first embodiment.

12 Claims, 1 Drawing Sheet

APPARATUS FOR APPLYING HEAT-SHRINKABLE PLASTIC SLEEVES TO CONTAINERS

BACKGROUND OF THE INVENTION

The invention disclosed herein relates to apparatus for applying heat-shrinkable sleeves of plastic film to containers. The containers may be bottles in which case the sleeves are deposited over the neck and cap of the bottle and then shrunk with heat to serve as a security device for preventing or, at least indicating, unauthorized opening of the bottle.

Apparatus of the type mentioned is known in which a flattened tube is formed in a roll so that there is a crease or fold line at each edge of the tube. After being taken off of the roll, the tube is folded onto intermediate crease lines and cut into segments or short sleeves. After being cut, the sleeves pass through a free space and become nipped by two rollers. The rollers feed the sleeve through a guide that has a converging channel which causes the sleeve to open so, as it leaves the guide, a moving bottle catches one edge so that the sleeve slides over the mouth end of the bottle which is then transported to a device that crimps the sleeve after which it is subjected to heat for shrinking it tightly onto the bottle. This arrangement is disclosed in French Laid Open specification No. 2,503,689. At the inlet end of the guide there is a pair of rollers which are spaced from the cutter by approximately the length of a sleeve or slightly less. The rollers are driven with a greater speed than the tube withdrawal device. This known apparatus is adapted for handling relatively short sleeves made of rather stiff film material. A drawback of the known apparatus is a lack of sufficient guidance of the tubular film in the zone between the cutter and the creasing device as the two rollers engage the sleeves only when the sleeves have entered into the guide in which they are caused to spread open. Experience with this known device reveals that it frequently causes buckling of the film tubes before they are cut and to tilting, retardation or actual sticking of the separated sleeves in the zone between the cutter and the creasing and sleeve opening guide. The problem is particularly acute when the sleeves are short, as the latter, after separation from the tube must traverse a short distance through free space before the sleeves are grasped by the pair of rollers at the inlet of the guide device. Short sleeves are also inclined to tilt in the zone of the guide device, caused by friction on the guide channel. The known device is, therefore, unreliable and requires frequent operator involvement.

SUMMARY OF THE INVENTION

An object of the invention is to provide a plastic sleeve applying device having improved and reliable guidance and improved transportation of the separated sleeves so that even relatively short sleeves are applied at high output and without interruption.

In the new sleeve applying apparatus disclosed herein, the end of the tubular plastic sleeve is grasped within or shortly after passing the cutting device. In one embodiment, there is a sleeve transport comprised of the straight run of a friction belt against which the straight run of a close loop chain presses. The chain has friction grippers on it which press against the friction belt and thereby transport the tubular segments or sleeves at a speed greater than the speed at which the creased plastic tube is withdrawn from the roll. Disturbances such as misalignment and tilting or slipping of the sleeves is thus inhibited and this is true even when short sleeves are being applied such as those which only wrap around the cap of a bottle without extending very far down the neck of the bottle. Output is high and interruptions are practically eliminated.

Two embodiments of the new sleeve applying device will now be described in greater detail in reference to the drawings.

DESCRIPTION OF THE DRAWINGS

FIG. 2 is a sectional view of the device taken on a line corresponding to 2—2 in FIG. 1, the supporting frame being omitted from this view.

DESCRIPTION OF A PREFERRED EMBODIMENT

Figure 1:
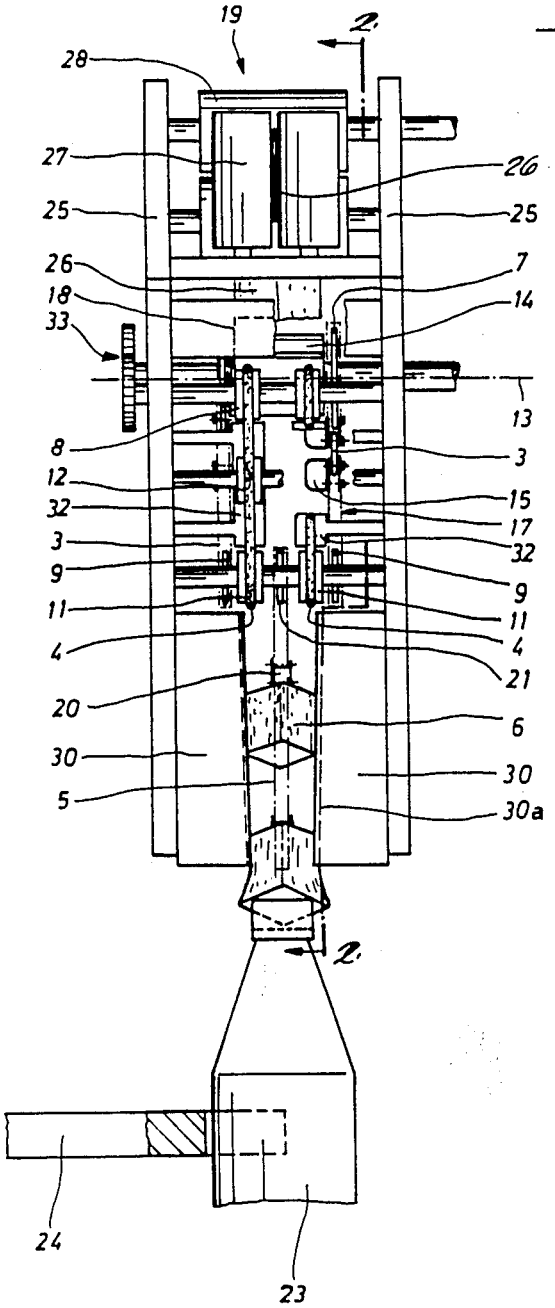
FIG. 1 is a front elevational view of the new device for applying heat-shrinkable sleeves to bottles.

Refer now to FIGS. 1 and 2 for a description of one embodiment of the new device that is especially efficacious for applying short heat-shrinkable film sleeves 6 on the closures of upright bottles 23. The bottles are transported past the sleeve applying device by means of a star wheel 24, a fragment of which is shown. A rigid frame comprised of two spaced apart vertical plates 25 is arranged above star wheel 24. The mechanism for depositing the plastic heat-shrinkable sleeves on the closures or head end of the bottles 23 is mounted on the frame as will be described.

As is most evident in FIG. 2, the flat plastic film tube 26 is unwound from a supply reel, not shown, rotating about a vertical axis, by means of a withdrawal device 19 having three synchronously driven pairs of rollers 27, 28 and 29 which, among other things, guide the plastic tube to a cutting device 1. The first pair of rollers 27 turn on parallel vertical axes so the flattened tube 26 passes between these rollers while lying in a vertical plane. The upper and lower edges of plastic tube 26 are, of course, creased since the plastic tube is wound in a flat condition on the reel. The other pairs of rollers 28 and 29 have small v-grooves in their peripheries and smooth circular areas on opposite sides of the grooves so as to bring about a folding of the tube 26 in a plane offset by 90 degrees to the original folding plane such that the plastic tube receives two additional crease lines. If the tube were allowed to spring open after leaving roller pair 29, the tube would form the boundaries of a square or nearly square space whose corners are formed by the four creases.

After leaving rollers 29, the tube 26 of plastic film is directed downwardly to a cutting device 1. The cutting device has a stationary knife 18 cooperating with the shearing blades 16 which are mounted to a roller 14 which rotates about a horizontal axis. The plastic film tube is cut into segments or short sleeves each time one of the rotating cutter blades 16 passes the stationary blade 18. At this time, the sleeves 6 are still flat.

Located considerably below cutting device 1 is a sleeve opening device 2. Device 2 comprises two laterally spaced apart stationary slide members 30 which define a tapering guide channel whose opposite sides converge so that the channel between them becomes smaller in the direction in which the sleeves 6 are transported which is nearly vertical as shown. There are v-shaped grooves 30*a* facing one another and extending over the length of slide members 30. At the upper end of the channel between the slide members 30 the grooves are spaced apart by an amount substantially equal to the width of a flat sleeve 6. Because of being pushed down the channel with two of its creased corners sliding in the grooves 30*a*, the sleeve tends to spring open and it does open by nearly a maximum amount by the time it arrives at the discharge end of the channel which is at the lower end of guide members 30. The opening defined by the sleeve is close to being square in cross section when the sleeve is about to emerge from the channel. As is evident in FIGS. 1 and 2, the bottles 23, moving horizontally, approach the sleeves with a relative angle between them so that the closure end of the bottles makes positive engagement with the interior of the heat-shrinkable plastic sleeve 6. Continual rotation of the star wheel 24 carries the bottles with a sleeve 6 fitting over their closure end to a device, not shown, which crimps the sleeves in preparation for having the bottles pass through a heating device, not shown, wherein the sleeves are heat shrunk in tight sealing relation on the bottle closures to preclude any unauthorized tampering with the closure.

The manner in which the sleeves are conveyed from the cutter 1 through the slide members 30 will now be described and then the manner in which the sleeves are transported from cutter 1 to the inlet of the slide members 30 will be described. Adjacent the slide members 30 there is a closed loop chain 5 which runs over a drive sprocket 21 and a lower idler sprocket 22. The chain 5 runs along the length of the gap between the two slide members 30. Chain 5 is equipped, in the illustrated embodiments, with four hook members 20 which are spaced apart by equal distances along the chain loop 5. Hook members 20 on the chain pass around upper drive sprocket 21 and then descend to catch the trailing end of the sleeve 6 for driving the sleeve down the channel defined by spaced apart slide members 30. As previously mentioned, as the sleeves 6 are being pushed down the converging channel between the slide members they open or expand in one direction from their flat condition until they arrive at the lower end of the slide members 30 where they are intercepted by the heads of the passing bottles 23. Because of the slide members 30 being at a slight incline with respect to vertical, the closure ends of the bottles 23 enter into the lower opening of the opened sleeves and the sleeves are drawn out from between the slide members 30.

The means for handling the sleeve segments between the point where they are cut off and the inlet to the guide members 30 will now be described. There is a pair of sprockets 9 arranged on the same shaft concentrically to driving sprocket 21 for concurrent rotation with the sprocket that drives hook carrying chain 5. The sprockets 9 and 21 have the same size. The circumferential and linear speeds of the knife blade carrying roller 14, friction belt 4 and chain 5 are equal. The sizes of these sprockets are so related to the sizes or diameters of the rollers 27, 28 and 29 that the cut sleeves are transported at a substantially higher speed than the linear speed of the flat tube 26 before it is cut into segments or short sleeves.

The cutters 16 and the sprockets 7 for driving the two chain loops 3 rotate about the same axis 13. There are short angularly shaped friction actuator or shoe elements 15 attached to the links of the two chains 3. These shoe elements 15 extend laterally inward toward each other from chains 3. Elements 15 are depicted on only one of the chains in FIG. 1. The faces of these shoes are slightly arched or v-grooved for accommodating the creases in the presently flat tubular plastic segments or sleeves 6. There are gaps 17 along the lengths of the pair of chains 3 in which there are no shoe elements 15 fastened to the chains. The speed and timing of the shoe element 15 positioning is such, however, that there will be shoes ready to frictionally grip the flat plastic tube 26 just before the tube passes between rotating and stationary cutter blades and before the short sleeve is cut. The flexible members in the form of closed loop chains in the pair of chains 3 run on sprockets 7 which are each located axially outside of the cutter blades 16 on roller 14, the sprockets being fixed on the same shaft as the roller. The arrangement is such that the tube 26 can be gripped and stabilized during cutting but there is never any interference between the shoes and the blades. In the straight descending run of closed loop chains 3 between upper drive sprocket 7 and lower idler sprocket 9 the two chains 3 are supported by a stationary flat guide rail 31.

On the side opposite of the two chains 3, two belts 4 of high friction material having circular cross section translate in parallel vertical planes about an upper pair of drive pulleys 8 and two idler pulley pairs 11 and 12. The place where the belts 4 make first tangential contact with the sleeve or segment 6 residing between the belts and the actuator or shoes 15 on drive chains 3 is below but very close to the stationary knife 18. The lower idler pulley pair 11 is located at the height of the sprockets 9 for chains 3. The two belts 4 are backed up or supported by means of stationary slide rails 32. The shoes 15 on the chains 3 and the belts 4 interface in slight compressive relationship with each other or on the sleeve supported by the shoes so that as a result of translation of the belts and chains the sleeves 6 are advanced to the point where one of the grippers or hook members 20 engages the upper rim of the sleeves 6 at the inlet to the spaced apart slide members 30. The pulleys 8 for belts 4 are driven by means of a drive sprocket 33 in such manner that the two belts 4 have the same circumferential speed as the chains 3 and their friction grip elements or actuators 15 and at the same speed as the chains 5 with their hook elements 20. The knife blade carrying roller 14 and the pairs of rollers 27, 28 and 29 of the tube withdrawal device 19 are driven synchronously with the star wheel 24 so that a sleeve 6 is brought in front of the head of an approaching bottle 23 at the correct point in time. As previously indicated, the chains 3 and 5 and the belts 4 are driven with greater linear speed than the pairs of rollers 27, 28 and 29. The resulting acceleration of sleeves 6 after separation from tube 26 is necessary to assure that the sleeves 6 encounter the approaching bottle head at the lowermost end of slide members 30. The sleeves 6, of course, are not allowed to arrive at their lower end positions early because there is a weak grip between slide members 30 and the sleeves due to the inherent springiness of the sleeves 6 which cannot reliably prevent an unintentional dropping of the sleeves.

When the sleeves 6 are grasped by the actuator or shoe elements 15 on chain 3 and the belts 4, the sleeves are held rigidly between the belts and shoes and buckling is prevented. As soon as a sleeve is separated by cooperation of the rotating knife 16 and stationary knife 18 the retarding or braking effect on the flat plastic tube 26 by withdrawal device 19 terminates and the sleeve is grasped fully by the belts 4 and actuators 15 and the sleeves travel at higher translational speed. Sleeve 6 is then pushed in the gap between the slide members 30 and grasped at their trailing edge by a driver actuator or hook member 20 on chain 5 and pushed completely through the sleeve 6 expanding and reshaping device 2. Hence, the sleeves 6 are, from the instant of their separation from the tube 26 to their discharge at the lower end of slide members 30 always transported and guided firmly. They are never allowed to move freely solely under the influence of gravity.

Figure 3:
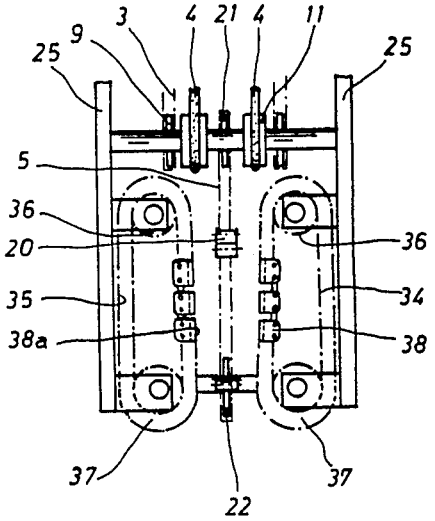
FIG. 3 is a partial front view of an alternative embodiment of the device for applying shrinkable sleeves on bottles.

In the FIG. 3 embodiment, the slide members 30 of the FIGS. 1 and 2 embodiment are replaced by two additional closed loop chains 34 and 35 which translate in a common plane. This plane is disposed at 90 degrees with respect to the translational plane of chain 5 which carries the hook elements 20. Closed loop chains 34 and 35 form the converging open channel in this embodiment for causing the sleeves to open. Chains 34 and 35 travel over upper drive sprockets 36 and lower idler sprockets 37 and are provided with short holder or guide members 38 which have a toothed or indented guide surface 38*a* into which one pair of opposite creased edges of the sleeves 6 engage. Chains 34 and 35 have a greater spacing between them at their upper ends than at their lower ends. In other words, the chains when making their common vertical descent converge toward the lower level and cause the sleeves which have been fed in between them to be squeezed open as was accomplished with the converging channel between the slide members 30 in the FIGS. 1 and 2 embodiment. With the FIG. 3 embodiment, transportation and guidance of the sleeves 6 is further improved since the friction which existed between the stationary guide members 30 in the FIGS. 1 and 2 embodiment is completely eliminated. Of course, it is still necessary for the two chains 34 and 35 to be driven translationally with the same linear speed as chain 5.

After the sleeves 6 are deposited on the closures or seals of the bottles 23, the sleeves are still loosely seated. They are tightly sealed in a subsequent heating station, now shown, wherein the sleeves are heated by any suitable means such as hot air or infrared radiation which causes them to shrink and adhere tightly on the closure and the neck of the bottle.

I claim:

1. Apparatus for applying shrinkable film sleeves to moving containers, comprising:

a withdrawal and creasing device (19) having an inlet to which a flattened and creased longitudinally creased film (26) is fed and an outlet from which said tube with additional creases emerges, a cutting device (1) including rotating (16) and cooperating stationary (18) blades between which said creased tube passes for being cut into individual generally flat tubular sleeves (6), drawing means including adjacent translationally driven pairs of flexible members (3,4) formed in closed loops having means for engaging said film tube (26) immediately before said tube is cut so as to advance the resulting sleeve (6) after it is cut, sleeve opening means including laterally spaced apart longitudinally extending members (30, 34, 35) defining a channel that converges from an inlet to an outlet into which inlet said sleeves are discharged from said drawing means and along which channel said sleeves are moved while at least two opposed creases therein are supported on said converging members, and means (5, 20, 34, 35, 38) for engaging said sleeves adjacent said inlet and for moving said sleeves to said outlet to cause said sleeves to be open at the outlet for being applied to a container.

2. The apparatus according to claim 1 wherein said members that define said converging channel are elongated spaced apart stationary slide members (30) each of which has a corresponding longitudinally extending groove (30*a*) into which opposite creases of said sleeves register for being moved down said channel, and means (5, 20) for pushing said sleeves along said channel.

3. The apparatus according to claim 1 wherein said members that define said converging channel are endless loop flexible members (34, 35) lying in a common plane and rotating means on which said endless loop flexible members translate, corresponding straight runs of said flexible members being spaced apart laterally in nonparallel relationship for converging between said inlet and outlet, elements (38) on said translating endless loop flexible members having recesses in which opposite creases of said sleeves register for being moved along said channel, and means (5, 20) for moving said sleeves along said channel in conjunction with said endless loop flexible members.

4. The apparatus according to any one of claims 2 or 3 including a roller (14) on which said rotating blades are mounted and the axis of rotation of said roller lies within the path of translation of said translationally driven flexible members.

5. The apparatus according to claim 4 wherein said translationally driven flexible members (3, 4) are driven at the same speed as said roller.

6. The apparatus according to any one of claims 1, 2, or 3 wherein the sleeve transporting speed of said drawing means is greater than the speed at which said withdrawal and creasing device withdraws said tube.

7. The apparatus according to any one of claims 1, 2 or 3 wherein the length of said drawing means is a multiple of said rotating blades, said translationally driven flexible members of said drawing means translating adjacent the path of movement of said sleeves, said means for engaging said tube before it is cut comprising shoe elements mounted to said flexible members for frictionally engaging said film tube and in the region where the cutter blades engage there is a gap along said flexible members that is without said shoe elements.

8. The apparatus according to claim 7 including a roller on which said rotating cutter blades are mounted in equiangularly spaced apart relationship, said flexible members translating in parallelism on opposite sides of said cutter blades and said elements on each flexible member project toward each other but leaving a gap between them.

9. The apparatus according to claim 1 wherein one of said pairs of flexible members consist of flexible belts and the other pair consists of flexible chains, said flexible members exerting slight mutual pressure on each other.

10. The apparatus according to claim 1 wherein said rotatable blades are rotatable at a higher speed than the speed at which said withdrawal and creasing device withdraws said tube.

11. The apparatus according to claim 1 including slide rail means (31, 32) on which said pairs of flexible members slide, respectively, said rail means being arranged along straight portions of said members and in parallel and close enough to each other to press said pairs of members lightly toward each other for gripping and transporting sleeves between said members when said sleeves are discharged from said cutting device.

12. The apparatus according to claim 11 wherein one pair of said flexible members consists of flexible belts.

* * * * *